US011015618B2

(12) United States Patent
Iizuka et al.

(10) Patent No.: US 11,015,618 B2
(45) Date of Patent: May 25, 2021

(54) CENTRIFUGAL COMPRESSOR

(71) Applicant: IHI Corporation, Koto-ku (JP)

(72) Inventors: Kuniaki Iizuka, Koto-ku (JP); Takashi Yoshida, Koto-ku (JP); Yuji Sasaki, Koto-ku (JP); Tatsumi Inomata, Koto-ku (JP); Takuya Ozasa, Koto-ku (JP); Ryosuke Yumoto, Koto-ku (JP); Takashi Mori, Koto-ku (JP)

(73) Assignee: IHI Corporation, Koto-ku (JP)

( * ) Notice: Subject to any disclaimer, the term of this patent is extended or adjusted under 35 U.S.C. 154(b) by 68 days.

(21) Appl. No.: 16/330,873

(22) PCT Filed: Nov. 16, 2017

(86) PCT No.: PCT/JP2017/041260

§ 371 (c)(1),
(2) Date: Mar. 6, 2019

(87) PCT Pub. No.: WO2018/092842

PCT Pub. Date: May 24, 2018

(65) Prior Publication Data

US 2019/0211845 A1 Jul. 11, 2019

(30) Foreign Application Priority Data

Nov. 17, 2016 (JP) ..... JP2016-224286

(51) Int. Cl.
*F04D 29/70* (2006.01)
*F02B 39/02* (2006.01)
(Continued)

(52) U.S. Cl.
CPC ..... *F04D 29/706* (2013.01); *F02B 33/40* (2013.01); *F02B 39/00* (2013.01); *F02B 39/02* (2013.01);
(Continued)

(58) Field of Classification Search
CPC .. F04D 29/42; F04D 29/4206; F04D 29/4213; F04D 29/70; F04D 29/701;
(Continued)

(56) References Cited

U.S. PATENT DOCUMENTS 2,301,063 A * 11/1942 McConaghy ..... F04D 13/0653 417/370
2,470,565 A * 5/1949 Loss ..... F04D 27/0207 415/27
(Continued)

FOREIGN PATENT DOCUMENTS

CN 1281535 A 1/2001
CN 101504002 A 8/2009
(Continued)

OTHER PUBLICATIONS

JP 2009041551 English Machine Translation by ProQuest translated on Jul. 20, 2020 (Year: 2009).*
(Continued)

*Primary Examiner* — Igor Kershteyn
*Assistant Examiner* — Wayne A Lambert
(74) *Attorney, Agent, or Firm* — Oblon, McClelland, Maier & Neustadt, L.L.P.

(57) ABSTRACT

A centrifugal compressor includes a compressor impeller attached to a rotary shaft and a housing accommodating the rotary shaft and the compressor impeller. The housing includes a suction portion formed upstream of the compressor impeller and a high pressure part formed on a rear face side of the compressor impeller and having a pressure higher than a pressure in the suction portion during rotation of the compressor impeller. The housing has a discharge passage formed for connecting the high pressure part to a low pressure part including the suction portion and a gas flow path upstream of the suction portion.

13 Claims, 5 Drawing Sheets

(51) Int. Cl.
*F02B 33/40* (2006.01)
*F04D 29/42* (2006.01)
*F02B 39/00* (2006.01)

(52) U.S. Cl.
CPC ..... *F04D 29/42* (2013.01); *F04D 29/4206* (2013.01); *F04D 29/70* (2013.01)

(58) Field of Classification Search
CPC .... F04D 29/706; F04D 13/06; F04D 27/0207; F05D 2260/602; F05D 2260/608; F02B 39/00; F02B 39/02; F02B 39/10; F02B 39/12; F02B 33/40; F02M 26/35
USPC ..... 415/11, 169.2
See application file for complete search history.

(56) References Cited

U.S. PATENT DOCUMENTS 2,888,193 A 5/1959 Greenwald
3,096,785 A * 7/1963 Hornschuch ..... F04D 27/0215 137/565.35
3,104,964 A * 9/1963 Craft ..... F04D 29/706 55/406
3,740,163 A * 6/1973 Schinnerer ..... F01D 25/22 415/111
4,725,206 A * 2/1988 Glaser ..... F01D 25/125 415/175
5,087,176 A * 2/1992 Wieland ..... F01D 5/025 415/177
6,102,672 A 8/2000 Woollenweber et al.
7,988,426 B2 * 8/2011 Elpern ..... F04D 29/063 417/53
8,192,144 B2 * 6/2012 Shibata ..... F04D 29/4206 415/108
8,418,461 B2 * 4/2013 Siuchta ..... F02M 26/30 60/605.1
9,291,167 B2 3/2016 Schreiber
2008/0232952 A1 * 9/2008 Gu ..... F04D 27/0215 415/11
2009/0193841 A1 8/2009 Sugitani
2010/0290896 A1 11/2010 Lenderink et al.
2016/0102677 A1 * 4/2016 An ..... F02B 39/10 417/369
2017/0002773 A1 * 1/2017 Segawa ..... F02B 29/02
2018/0372032 A1 * 12/2018 Sommerhoff ..... F02M 26/35

FOREIGN PATENT DOCUMENTS

JP 59-160023 A 9/1984
JP 9-121510 A 5/1997
JP 10-281573 A 10/1998
JP 2001-515991 A 9/2001
JP 2005-192355 A 7/2005
JP 2007-9717 A 1/2007
JP 2009-41551 A 2/2009
JP 2009041551 A * 2/2009

OTHER PUBLICATIONS

International Search Report dated Jan. 23, 2018 in PCT/JP2017/041260, citing documents AA, and AP through AS therein, 2 pages.

* cited by examiner

CENTRIFUGAL COMPRESSOR

TECHNICAL FIELD

The present disclosure relates to a centrifugal compressor.

BACKGROUND ART

Patent Literature 1 discloses, as a centrifugal compressor, a turbocharger incorporated into an internal combustion engine of a vehicle. The turbocharger includes a compressor and a turbine. This internal combustion engine includes an exhaust reflux device that introduces a portion of exhaust as exhaust gas recirculation (EGR) gas. The exhaust reflux device includes a low pressure EGR passage that is connected to the compressor of the turbocharger via an air intake passage of the internal combustion engine.

A trapper is formed between the air intake passage and the low pressure EGR passage for collecting condensed water generated, for example, from the EGR gas. A tank for storing the condensed water is connected to the trapper. A groove is formed on a housing of the compressor of the turbocharger. This groove is connected to a casing of the trapper via a condensed water passage. When the condensed water moves along an inner surface of the air intake passage, it is collected in the groove of the compressor, passes through the condensed water passage and the trapper, and is stored in the tank.

CITATION LIST

Patent Literature

Patent Literature 1: Japanese Unexamined Patent Publication No. 2009-41551

SUMMARY OF INVENTION

Technical Problem

In the device disclosed in Patent Literature 1 above, the condensed water that moves along the inner surface of the air intake passage is collected in the groove before being sucked into the compressor and is discharged toward the trapper and the tank. However, in the device disclosed in Patent Literature 1, no consideration is given to the discharge of condensed water in a case in which there is condensed water inside the turbocharger.

In a centrifugal compressor such as a turbocharger, condensed water may be generated inside the housing. It is desirable for the condensed water accumulated in the housing to be discharged externally in some way. Previously, it was necessary to separately provide large-scale devices, such as additional installation of piping to externally discharge the condensed water. The present disclosure describes a centrifugal compressor that is capable of externally discharging condensed water with a simple configuration.

Solution to Problem

A centrifugal compressor according to one embodiment of the present disclosure includes a compressor impeller attached to a rotary shaft and a housing accommodating the rotary shaft and the compressor impeller, wherein the housing includes a suction portion formed upstream of the compressor impeller and a high pressure part formed on a rear face side of the compressor impeller and having a pressure higher than a pressure in the suction portion during rotation of the compressor impeller, and the housing has a discharge passage formed for connecting the high pressure part to a low pressure part including the suction portion and a gas flow path upstream of the suction portion.

Effects of Invention

According to one embodiment of the present disclosure, a discharge mechanism utilizing pressure difference is capable of externally discharging condensed water inside a housing with a simple configuration.

DESCRIPTION OF EMBODIMENTS

Figure 1:
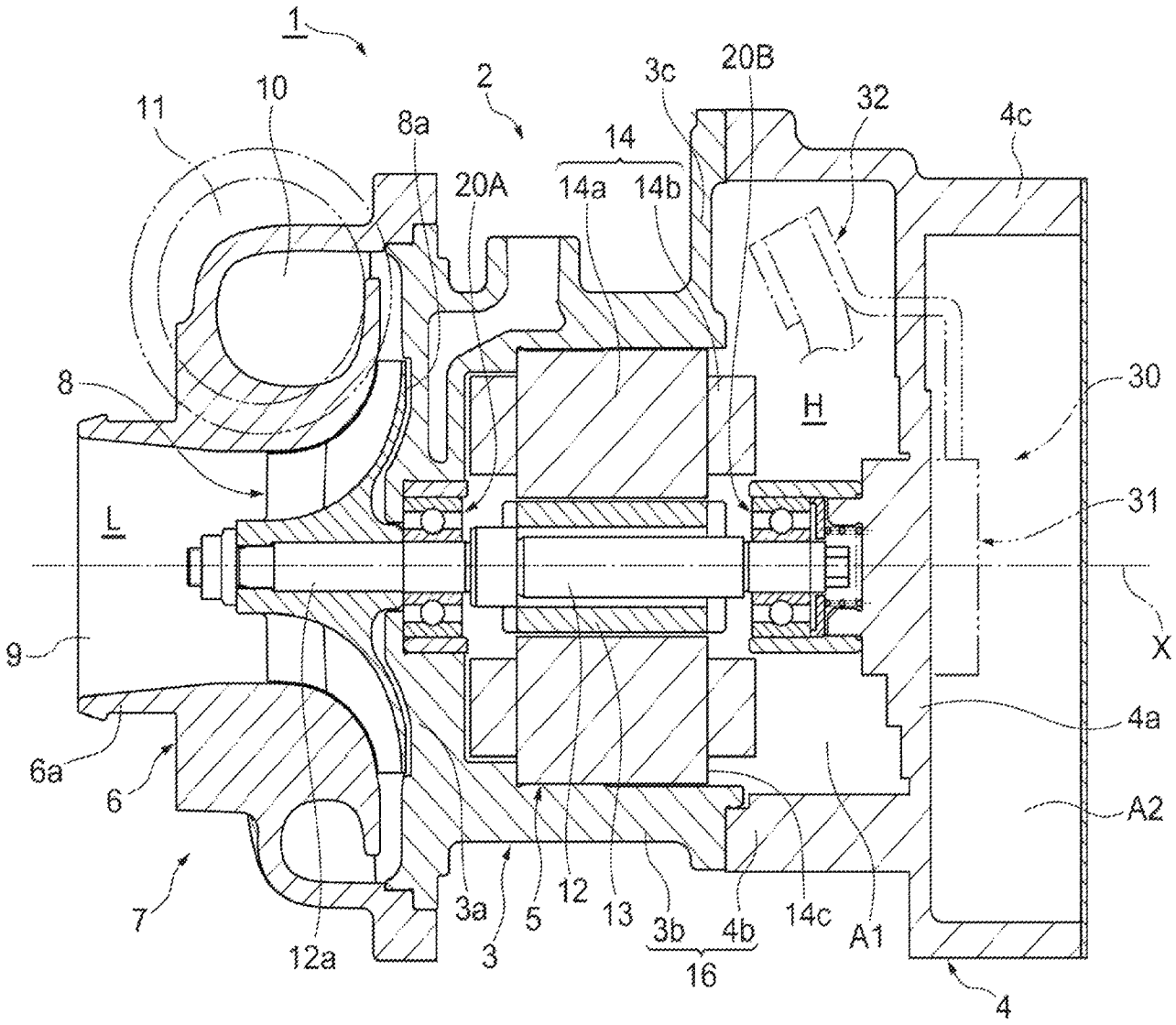
FIG. 1 is a cross-sectional view showing a centrifugal compressor according one embodiment of the present disclosure.

A centrifugal compressor according to one embodiment of the present disclosure includes a compressor impeller attached to a rotary shaft and a housing accommodating the rotary shaft and the compressor impeller, wherein the housing includes a suction portion formed upstream of the compressor impeller and a high pressure part formed on a rear face side of the compressor impeller and having a pressure higher than a pressure in the suction portion during rotation of the compressor impeller, and the housing has a discharge passage formed for connecting the high pressure part to a low pressure part including the suction portion and a gas flow path upstream of the suction portion.

According to this centrifugal compressor, condensed water inside the housing is discharged from the high pressure part to the low pressure part through the discharge passage. The high pressure part has a pressure higher than the pressure in the suction portion during rotation of the compressor impeller (i.e., during operation of the centrifugal compressor). Since the discharge passage connects the high pressure part to the low pressure part, the discharge passage is capable of discharging the condensed water utilizing the pressure difference. It is only necessary to arrange a pipe or the like that forms the discharge passage in the housing in advance and no additional installation, for example, of piping is required to externally discharge the condensed water. Such a discharge mechanism utilizing pressure difference is capable of externally discharging the condensed water inside the housing with a simple configuration.

In some embodiments, the centrifugal compressor further includes a stator portion disposed around the rotary shaft, wherein the housing has a peripheral wall formed on the rear face side of the compressor impeller and supporting a core portion of the stator portion, and an end wall formed on an opposite side of the peripheral wall from the compressor impeller, the high pressure part includes an inner space defined by the peripheral wall and the end wall, and the discharge passage is connected to the inner space at a location closer to the end wall than the core portion. When the stator portion is formed inside the housing, the condensed water may adversely affect the stator portion by accumulating in the vicinity of the stator portion. For example, if the accumulated condensed water freezes while the centrifugal compressor is at rest, malfunction may occur upon restart. The condensed water is less likely to accumulate in the vicinity of the core portion if the discharge passage is connected at a location closer to the end wall than the core portion as in the configuration above. Negative effects on the stator portion can thus be reduced.

In some embodiments, the housing has a condensed water reservoir included in the high pressure part and formed on a lower part of the housing of the centrifugal compressor in use. The condensed water reservoir being formed on the lower part of the housing allows the condensed water to be stored in the condensed water reservoir by the force of gravity. The condensed water can thus be collected at a fixed place inside the housing. When discharging the condensed water, the condensed water can also be discharged collectively from the condensed water reservoir.

In some embodiments, a connection port at which the discharge passage is connected to the high pressure part is formed on the lower part of the housing of the centrifugal compressor in use. The condensed water may vaporize during operation of the centrifugal compressor due to the inside of the housing becoming hot. In vapor form, the condensed water can be discharged even if a discharge port (connection port) of the condensed water is on an upper part. However, when the temperature inside the housing is relatively low as, for example, during startup of the centrifugal compressor, the condensed water may be in liquid form. The connection port of the discharge passage being formed on the lower part of the housing allows the condensed water to be discharged easily from the connection port utilizing the pressure difference even when the condensed water is in liquid form.

In some embodiments, a groove portion extending toward the connection port is formed on an inner wall face of the housing. In this case, the condensed water can be collected in the groove portion on the inner wall face. The condensed water can be guided to the connection port through the groove portion by the force of gravity.

In some embodiments, the discharge passage connects the high pressure part of the housing to the suction portion of the housing. In this case, the condensed water is refluxed to the suction portion from the high pressure part. The condensed water accumulated inside the housing can be discharged effectively utilizing the pressure difference in the centrifugal compressor. There is no need to connect the discharge passage, for example, to upstream piping. The problem is solved by the centrifugal compressor alone.

Embodiments of the present disclosure will be described below with reference to the drawings. It should be noted that like elements are given like reference signs in the description of the drawings and that redundant explanation is omitted. In the following description, unless otherwise indicated, the terms "radial direction" and "circumferential direction" are used with reference to a rotary shaft 12 or an axis of rotation X.

An electric compressor (an example of a centrifugal compressor) of a first embodiment will be described with reference to FIG. 1. As shown in FIG. 1, an electric compressor 1 is applicable, for example, to an internal combustion engine of a vehicle or a vessel. The electric compressor 1 has a compressor 7. The electric compressor 1 rotates a compressor impeller 8 by interaction between a rotor portion 13 and stator portion 14, compresses gas such as air, and generates compressed air. The rotor portion 13 and the stator portion 14 form a motor 5.

The electric compressor 1 includes the rotary shaft 12 which is rotatably supported inside a housing 2 and the compressor impeller 8 which is attached to a distal end (first end) 12*a* of the rotary shaft 12. The housing 2 includes a motor housing 3 that accommodates the rotor portion 13 and the stator portion 14, an inverter housing 4 that closes an opening of a second end side (on the right in the figure) of the motor housing 3, and a compressor housing 6 that accommodates the compressor impeller 8. The compressor housing 6 is formed on a first end side (on the left in the figure) of the motor housing 3. The compressor housing 6 includes an inlet port 9, a scroll portion 10, and an outlet port 11.

The rotor portion 13 is fixed to a central portion of the rotary shaft 12 in a direction of the axis of rotation X and includes one or a plurality of permanent magnets (not shown) attached to the rotary shaft 12. The stator portion 14 is fixed to an inner side of the motor housing 3 so as to surround the rotor portion 13. That is, the stator portion 14 is disposed about the rotary shaft 12. The stator portion 14 includes a cylindrical core portion 14*a* that is disposed so as to surround the rotor portion 13 and a coil portion 14*b* that is formed by a conductive wire (not shown) being wound around the core portion 14*a*. When an alternating current is passed through the coil portion 14*b* of the stator portion 14 through the conductive wire, the rotary shaft 12 and the compressor impeller 8 rotate in unison due to the interaction between the rotor portion 13 and the stator portion 14. When the compressor impeller 8 rotates, the compressor impeller 8 sucks in outside air through the inlet port 9, compresses the air through the scroll portion 10, and discharges the compressed air from the outlet port 11. The compressed air discharged from the outlet port 11 is supplied to the internal combustion engine mentioned above.

The electric compressor 1 includes two bearings 20A, 20B that rotatably support the rotary shaft 12 with respect to the housing 2. The bearings 20A, 20B are disposed so as to sandwich the motor 5 and support the rotary shaft 12 at both ends. The first bearing 20A is held by a partition wall 3*a*, which is an end of the motor housing 3 facing the compressor impeller 8. The second bearing 20B is held at an inner side (facing the compressor impeller 8) of a partition wall (end wall) 4*a* of the inverter housing 4.

The configuration of the housing 2 will next be described in detail. The motor housing 3 includes a cylindrical peripheral wall 3*b* that supports the core portion 14*a* of the stator portion 14, the disc-shaped partition wall 3*a* that is formed on a first end side of the peripheral wall 3*b*, and a flange portion 3*c* that is formed on a second end side of the peripheral wall 3*b*. The partition wall 3*a* and the flange portion 3*c* extend in a direction radial to the axis of rotation X and perpendicular to the peripheral wall 3*b*. The core portion 14*a* may be positioned, in the direction of the axis of rotation X, within an area where the peripheral wall 3*b* is formed. That is, the core portion 14*a* may be disposed between the partition wall 3*a* and the flange portion 3*c*. An end of the core portion 14*a* in the direction of the axis of rotation X facing a partition wall 4*a* may overlap the position at which the flange portion 3*c* is formed in the direction of the axis of rotation X.

The peripheral wall 3*b* extends in the direction of the axis of rotation X. The partition wall 3*a* extends inward in the radial direction from the peripheral wall 3*b*. The rotary shaft 12 passes through the partition wall 3*a*. The partition wall 3*a* holds the first bearing 20A. The partition wall 3*a* faces a rear face 8*a* of the compressor impeller 8 with a small gap therebetween. The second end of the peripheral wall 3*b* is open to the inverter housing 4. The rotary shaft 12 extends opposite the compressor impeller 8 through this opening. The flange portion 3*c* extends outward in the radial direction from the peripheral wall 3*b*.

The inverter housing 4 includes a peripheral wall 4*b* that has a first end connected to the flange portion 3*c* and extends in the direction of the axis of rotation X (opposite the compressor impeller 8), the partition wall 4*a* that closes the opening of the peripheral wall 4*b* at a second end side thereof, and a side wall 4*c* that extends in the direction of the axis of rotation X from the peripheral edge of the partition wall 4*a*. The partition wall 4*a* extends in a direction radial to the axis of rotation X and perpendicular to the peripheral wall 4*b*. The second bearing 20B and a base end of the rotary shaft 12 are disposed inside the peripheral wall 4*b*. It should be noted that a portion of the stator portion 14 (for example, a portion of the coil portion 14*b*) may be disposed inside the peripheral wall 4*b*. The core portion 14*a* does not protrude into the inverter housing 4.

The inverter housing 4 has a mechanism for supplying a drive current to the stator portion 14. That is, the inverter housing 4 has electrical components 30 that include, for example, an inverter. The peripheral wall 4*b* has therein a bus bar assembly 32 which is a conductive member that bundles conductive wires connected to the stator portion 14. For example, the bus bar assembly 32 is disposed in a space outward of the second bearing 20 in the radial direction. A module 31 that accommodates control components such as the inverter is fixed to an outer side of the partition wall 4*a*.

The peripheral wall 3*b* and the peripheral wall 4*b* form a peripheral wall 16 of the entire housing 2. The peripheral wall 16 is formed on the rear face 8*a* side of the compressor impeller 8 and supports the stator portion 14. The partition wall 4*a* is formed on an opposite side of the peripheral wall 16 from the compressor impeller 8. In the housing 2, a predetermined inner space A1 is defined by the partition wall 3*a*, the peripheral wall 16, the flange portion 3*c*, and the partition wall 4*a*. This inner space A1 is located on the rear face 8*a* side of the compressor impeller 8 across the partition wall 3*a*. The bus bar assembly 32 described above is disposed inside the inner space A1. The partition wall 4*a* and the side wall 4*c* form a module installation space A2. The partition wall 4*a* separates the inner space A1 and the module installation space A2.

Figure 2:
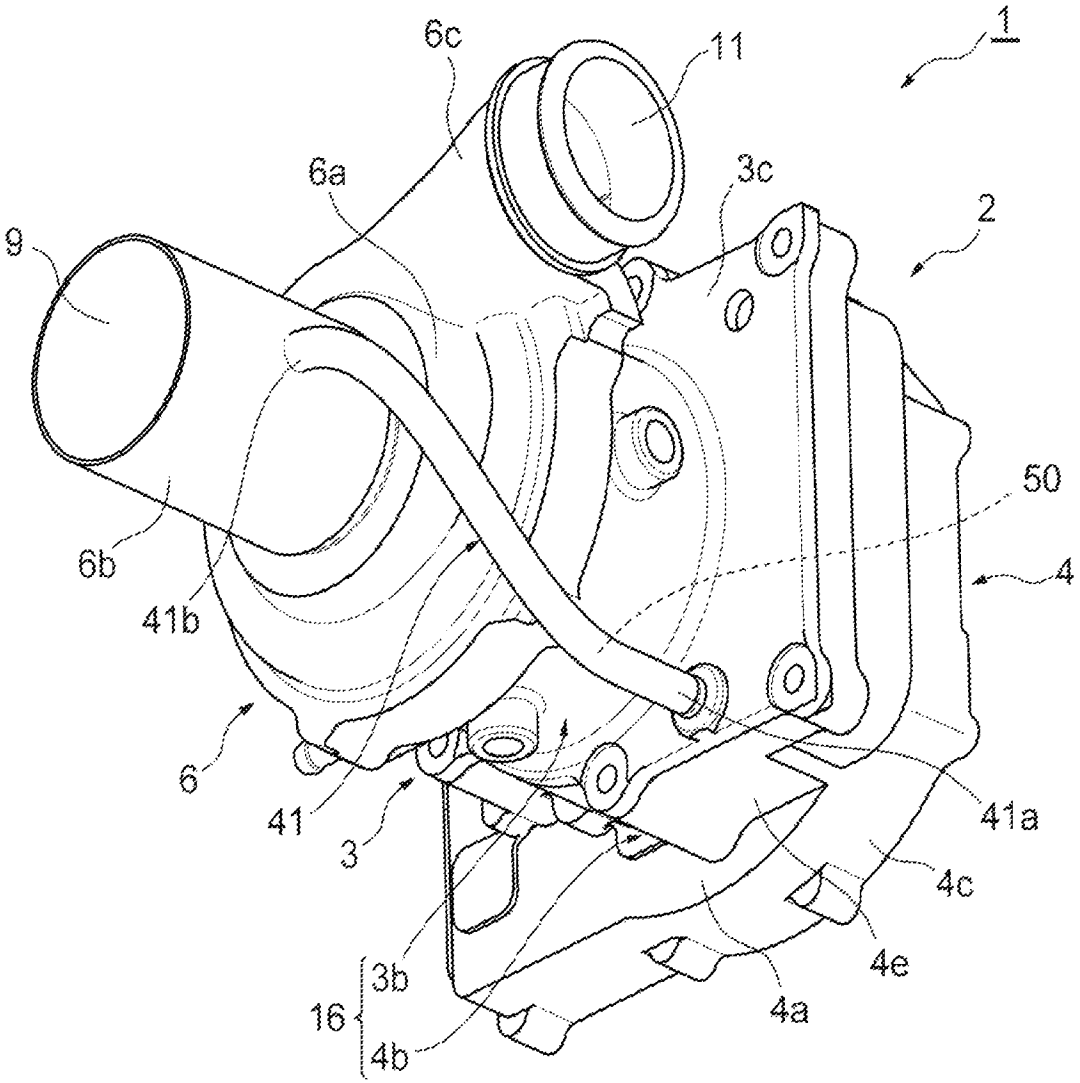
FIG. 2 is a perspective view showing the centrifugal compressor of FIG. 1.
Figure 3:
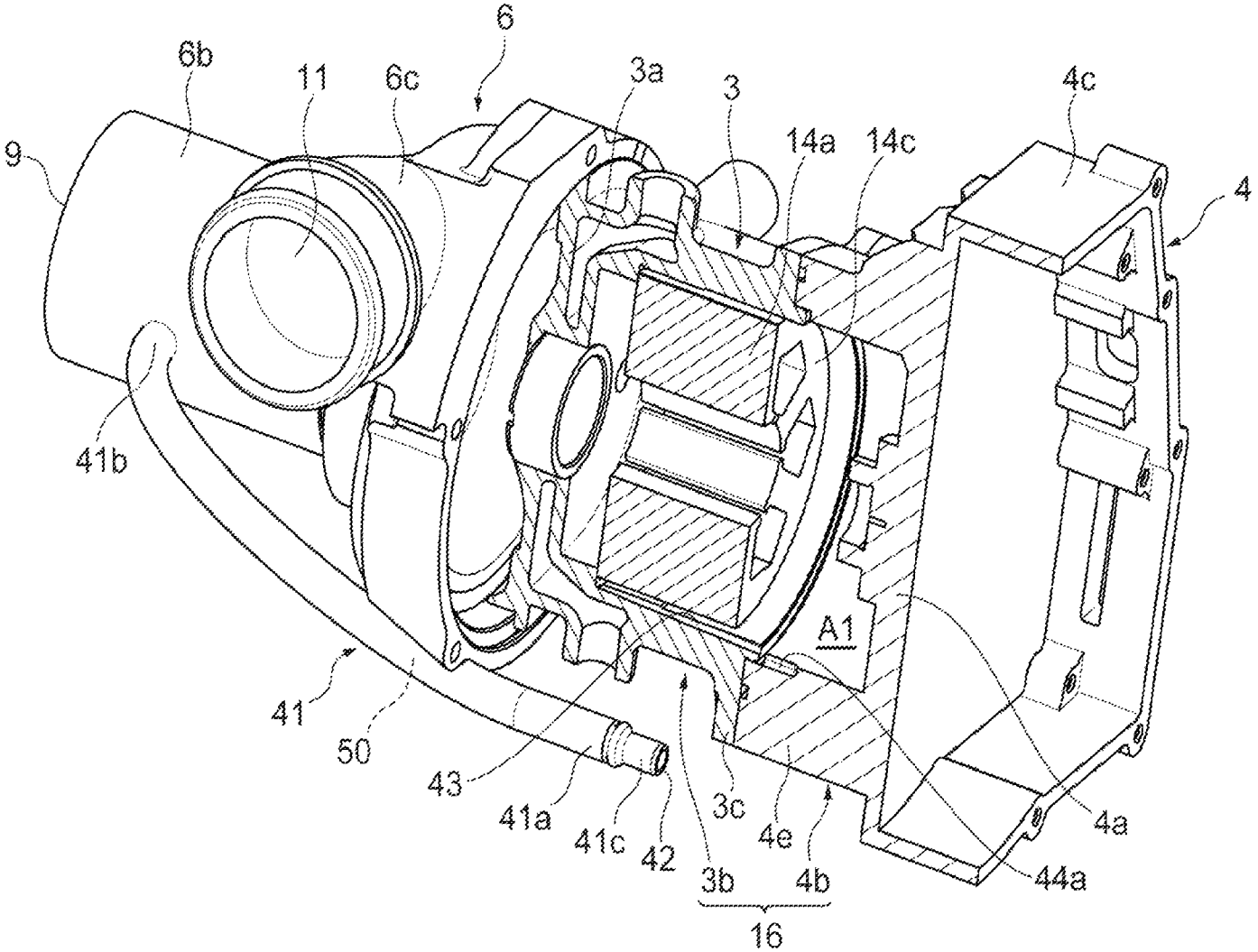
FIG. 3 is a perspective cross-sectional view showing an inner side of a housing.

As shown in FIGS. 2 and 3, the compressor housing 6 includes a suction pipe portion 6*a* that is located upstream of the compressor impeller 8 and forms the inlet port 9 and a discharge pipe portion 6*c* that is located downstream of the compressor impeller 8 and forms the outlet port 11. In the electric compressor 1, an extension suction pipe portion (suction portion) 6*b* is attached to the suction pipe portion 6 at a location upstream thereof. The suction pipe portion 6 may have a length that is about the same as the length as when the extension suction pipe portion 6*b* is attached. In other words, the extension suction pipe portion 6*b* may be integrated with the suction pipe portion 6*a* to form a portion of the suction pipe portion 6*a*.

During rotation of the compressor impeller 8, that is, during operation of the electric compressor 1, the pressure inside the suction pipe portion 6*a* and the extension suction pipe portion 6*b* (i.e., the inlet port 9) is relatively low. Meanwhile, the pressure inside the discharge pipe portion 6*c* (i.e., the outlet port 11) is higher than the pressure inside the suction pipe portion 6*a* and the extension suction pipe portion 6*b*, that is, the space upstream of the compressor impeller 8. Additionally, the pressure in the space downstream of the compressor impeller 8 (i.e., for example, the scroll portion 10) is higher than the pressure in the space upstream of the compressor impeller 8.

A space that is on the rear face 8*a* side of the compressor impeller 8 and surrounded by the motor housing 3 and the peripheral wall 4*b* and the partition wall 4*a* of the inverter housing 4 communicates with the space downstream of the compressor impeller 8 via a communication hole (not shown) formed in the partition wall 3*a*. The pressure in the space on the rear face 8*a* side of the compressor impeller 8 is thus closer to a discharge pressure and is higher than the pressure in the space upstream of the compressor impeller 8 during operation of the electric compressor 1. That is, a high pressure part H, which has a pressure higher than the pressure in the suction pipe portion 6*a* and the extension suction pipe portion 6*b* during rotation of the compressor impeller 8, is formed on the rear face 8*a* side of the compressor impeller 8. The high pressure part H includes the inner space A1 described above.

On the other hand, the suction pipe portion 6*a*, the extension suction pipe portion 6*h*, and a gas flow path upstream of the extension suction pipe portion 6*b* (including piping to be connected to the suction side of the electric compressor 1) form a low pressure part L (see, FIG. 1).

The electric compressor 1 of the present embodiment includes a mechanism that discharges condensed water that may accumulate inside the housing 2. More specifically, the electric compressor 1 includes a discharge passage 50 (see, FIGS. 2 and 4) that connects the high pressure part H to the low pressure part L which are described above. In the electric compressor 1, the discharge passage 50 is formed by a discharge pipe 41 that is disposed outside the housing 2 and is connected to the housing 2.

As shown in FIGS. 2 and 3, the discharge pipe 41 connects the motor housing 3 to the compressor housing 6. A first end 41*a* of the discharge pipe 41 is connected to the flange portion 3*c* of the motor housing 3. A second end 41*b* of the discharge pipe 41 is connected to the extension suction pipe portion 6*b* of the compressor housing 6. The first end 41*a* communicates the discharge passage 50 inside the discharge pipe 41 with the high pressure part H. The second end 41*b* communicates the discharge passage 50 inside the discharge pipe 41 with the low pressure part L. The high pressure part H thus communicates with the low pressure part L through the discharge pipe 41. The second end 41*b* may be connected to the suction pipe portion 6*a*.

More specifically, the first end 41*a* has a socket-shaped connection portion 41*c* which is inserted into a through hole formed in the flange portion 3*c*. A connection port 42 at the tip of the connection portion 41*c* is connected to the inner space A1. The second end 41*b* may be integrated with the extension suction pipe portion 6*b*. The second end 41*b* may have a socket-shaped connection portion that is inserted into a through hole formed in the extension suction pipe portion 6*b*. The connection of the discharge pipe 41 is not limited to the manner described above. For example, the first end 41*a* of the discharge pipe 41 may be connected to an external portion (hole portion) of the motor housing 3. It is only necessary that the first end 41*a* of the discharge pipe 41 communicate with the inner space A1. A connection portion such as a nipple to which both the first end 41*a* and the second end 41*b* can be connected may be formed on an external portion of the housing 2.

Figure 4:
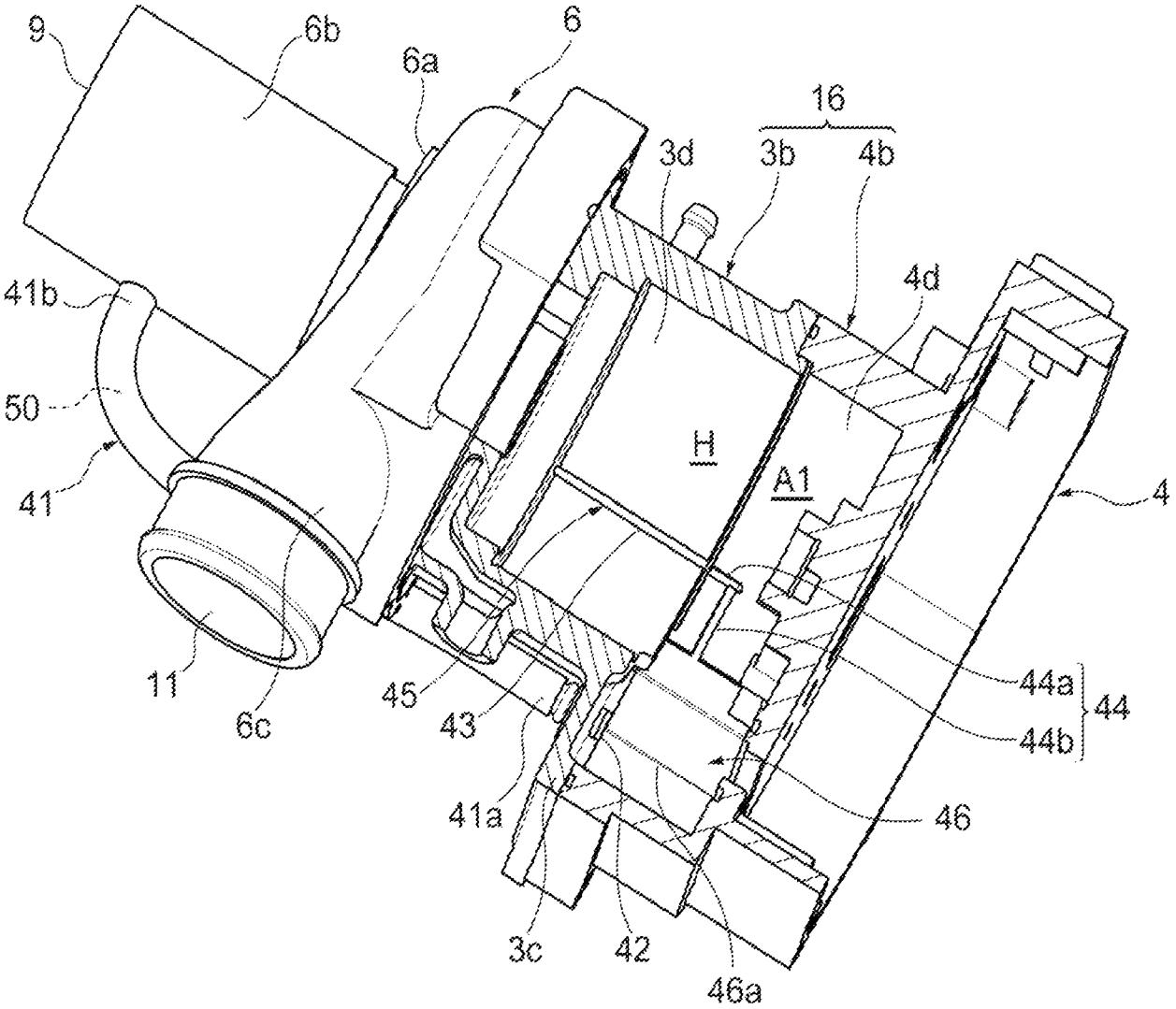
FIG. 4 is a perspective cross-sectional view showing the inner side of the housing.

The connection portion 41*c* of the discharge pipe 41 is connected to the inner space A1 at a location closer to the partition wall 4*a* than the core portion 14*a* of the stator portion 14. More specifically, the connection portion 41*c* is connected to the inner space A1 at a location closer to the partition wall 4*a* than an end surface 14*c* of the core portion 14*a*. As shown in FIGS. 3 and 4, the connection port 42 is formed on a lower part of the inverter housing 4. The terms "lower part" and "below" are used herein based on the electric compressor 1 in use (or is mounted). For example, the "lower part of the inverter housing 4" may be the part below the center (axis of rotation X) of the inverter housing 4. The inverter housing 4 includes a projection portion 4*e* (see, FIG. 3) which is a portion of the peripheral wall 4*b* and projects below the diameter of the peripheral wall 3*b* that corresponds to the stator portion 14. The connection port 42 of the discharge pipe 41 is connected to this projection portion 4*e*. When the electric compressor 1 is in use, the axis of rotation X may extend in a lateral direction. It should be noted that FIG. 3 is a cross section of the motor housing 3 and the inverter housing 4 cut through a vertical plane including the axis of rotation X. FIG. 4 is a cross section of the motor housing 3 and the inverter housing 4 cut through a horizontal plane including the axis of rotation X.

The discharge pipe 41 connects the high pressure part H to the low pressure part L to reflux the condensed water accumulated in the high pressure part H of the housing 2 to the low pressure part L during operation of the electric compressor 1. The connection port 42 of the discharge pipe 41 serves as a discharge port during reflux of the condensed water.

FIG. 4 is view showing inner sides of lower parts of the motor housing 3 and the inverter housing 4. As shown in FIG. 4, a first groove portion 43 that extends in the direction of the axis of rotation X is formed on an inner wall surface 3*d* of a lower part (bottom part) of the peripheral wall 3*b* and a lower part (bottom part) of the flange portion 3*c*. A second groove portion 44 is formed on an inner wall surface 4*d* of a lower part (bottom part) of the peripheral wall 4*b*. The second groove portion 44 includes an axial direction portion 44*a* that is formed on an extension of the first groove portion 43 and extends in the direction of the axis of rotation X and a circumferential direction portion 44*b* that is continuous with the axial direction portion 44*a* and extends in the circumferential direction.

Figure 5:
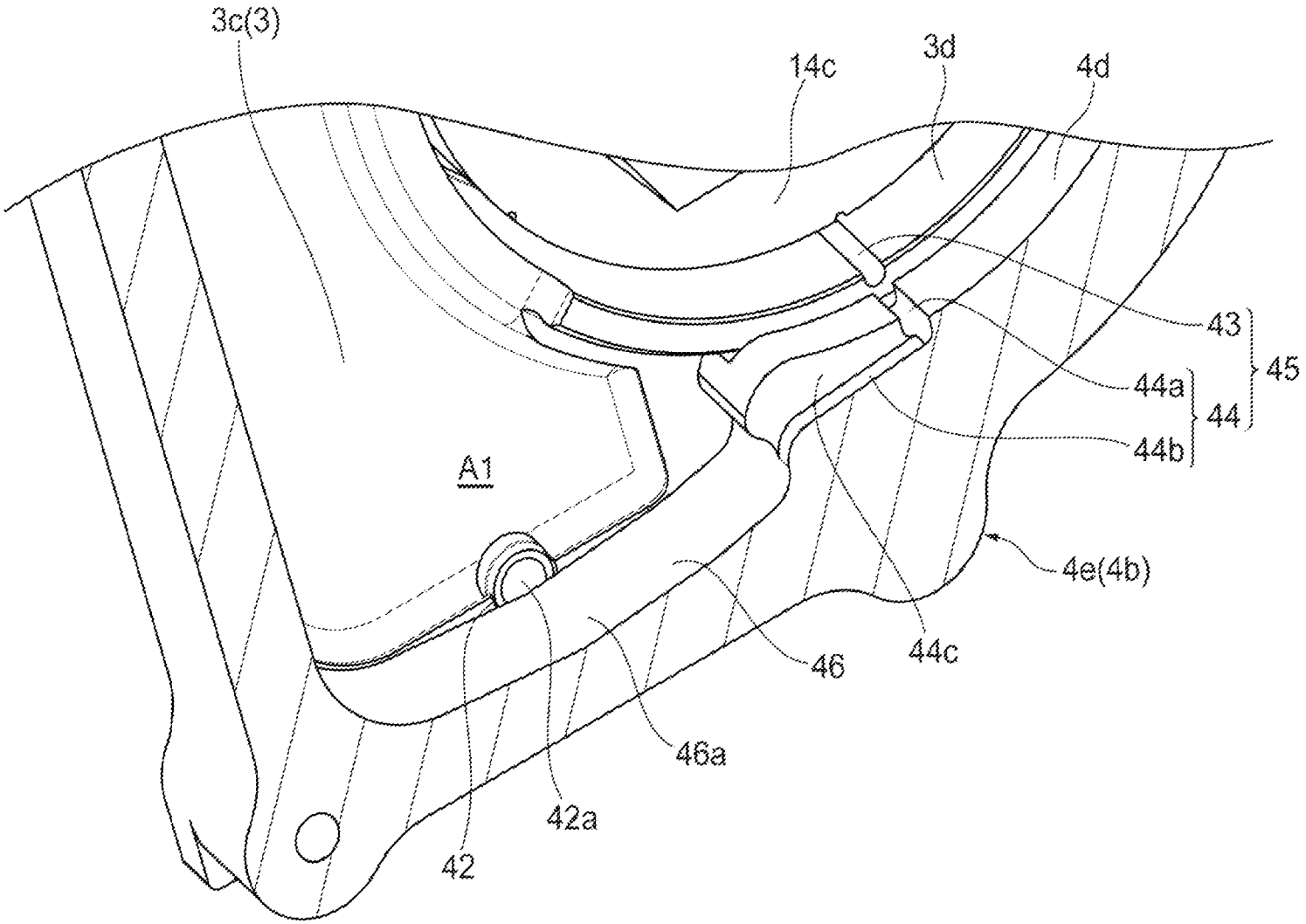
FIG. 5 is a perspective cross-sectional view showing a condensed water reservoir and a connection port.

As shown in FIG. 5, a side wall portion 44*c* (a portion of the second groove portion 44) that extends in the radial and circumferential directions is fainted between the circumferential direction portion 44*b* and the flange portion 3*c*. Furthermore, a condensed water reservoir 46 that is recessed below the circumferential direction portion 44*b* is formed in the projection portion 4*e* of the peripheral wall 4*b*. The recessed condensed water reservoir 46 is included in the inner space A1 (high pressure part H) and is formed in the lower part of the inner side of the inverter housing 4. The condensed water reservoir 46 is formed at a location closer to the partition wall 4*a* than the end surface 14*c* of the core portion 14*a*. The connection port 42 is formed so as to face the condensed water reservoir 46.

As shown in FIGS. 3, 4, and 5, the first groove portion 43 formed on the bottom parts of the peripheral wall 3*b* and the flange portion 3*c* and the second groove portion 44 formed on the bottom part of the peripheral wall 4*b* are, for example, continuous with a small gap formed therebetween. The first groove portion 43 that extends along the direction of the axis of rotation X and the L-shaped second groove portion 44 that changes its direction from the direction of the axis of rotation X to the circumferential direction form a groove portion 45 for collecting the condensed water inside the high pressure part H. This groove portion 45 is in communication with the condensed water reservoir 46. The groove portion 45 is a flow path for the condensed water. The first groove portion 43 and the second groove portion 44 extend toward the condensed water reservoir 46 and the connection port 42. The first groove portion 43 and the second groove portion 44 may become progressively deeper toward the connection port 42. In other words, the heights of the bottom parts of the first groove portion 43 and the second groove portion 44 may be progressively reduced toward the connection port 42. The circumferential direction portion 44*b* of the second groove portion 44 faces the condensed water reservoir 46. The condensed water reservoir 46 is formed at a location lower than the lowermost end of the first groove portion 43 and the second groove portion 44 (downstream end of the circumferential direction portion 44*b*). The condensed water reservoir 46 is formed in an area outward in the radial direction from the cylindrical peripheral wall 3*b* of the motor housing 3 (for example, in the projection portion 4*e* of the housing 2).

As shown in FIGS. 4 and 5, the condensed water reservoir 46 has, in the center of the bottom part thereof, for example, a valley portion 46*a* that extends in the direction of the axis of rotation X. The connection port 42 is formed in the vicinity of the valley portion 46*a* of the condensed water reservoir 46. As shown in FIG. 5, an inlet 42*a* of the connection port 42 may be open to the valley portion 46*a*. The inlet 42*a* of the connection port 42 need not be open to the lowermost part of the condensed water reservoir 46 and may be open to other suitable locations inside the condensed water reservoir 46.

A discharge operation of the condensed water in the electric compressor 1 having the above configuration will be described. During operation of the electric compressor 1, a portion of the gas boosted by the compressor 7 reaches the high pressure part H inside the motor housing 3 from the rear face 8*a* of the compressor impeller 8 by passing through the communication hole. The pressure in the high pressure part H becomes higher than the pressure on the suction side of the compressor impeller 8. At this point, gas with moisture mixed therein enters the motor housing 3.

After the engine (internal combustion engine) stops, for example, in cold regions, the temperature inside the motor housing 3 decreases, so that the moisture in the gas may condense into liquid. Since the motor housing 3 has the first groove portion 43 and the second groove portion 44 in the lower part thereof, these serve as a flow path for the condensed water which, by the force of gravity, flows through the first groove portion 43 and the second groove portion 44 and accumulates in the condensed water reservoir 46. It should be noted that the condensed water may, at this time, accumulate in the discharge pipe 41.

This downward flow through the flow path prevents the condensed water from collecting somewhere inside the motor housing 3, so that, for example, malfunction due to freezing at engine restart can be avoided. It should be noted that the condensed water is less likely to contact the core portion 14*a* even if the core portion 14*a* is adhered to the inner wall surface 3*d* of the peripheral wall 3*b* of the motor housing 3 since the first groove portion 43 recessed from the inner wall surface 3*d* is formed.

At engine restart, the condensed water may vaporize due to, for example, heating of the motor 5. A pressure difference is obtained between the low pressure part L on the suction side of the compressor impeller 8 and the high pressure part H inside the motor housing 3, so that the condensed water accumulated inside the motor housing 3 is discharged toward the extension suction pipe portion 6*b* through the discharge pipe 41 (discharge passage 50).

According to the electric compressor 1 of the present embodiment, the condensed water inside the housing 2 is discharged from the high pressure part H to the low pressure part L through the discharge passage 50. The high pressure part H has a pressure higher than the pressure in the extension suction pipe portion 6*b* during rotation of the compressor impeller 8 (i.e., during operation of the electric compressor 1). Since the discharge passage 50 connects the high pressure part H to the low pressure part L, the discharge passage 50 is capable of discharging the condensed water utilizing the pressure difference. It is only necessary to arrange the discharge pipe 41 that forms the discharge passage 50 in the housing 2 in advance and no additional installation, for example, of piping to externally discharge the condensed water is required. Such a discharge mechanism utilizing pressure difference is capable of externally discharging the condensed water inside the housing 2 with a simple configuration. In addition to not requiring, for example, piping for condensed water collection, the condensed water is refluxed by utilizing the already existing force of gravity, heating of the motor, and pressure difference between the housing 2 and the compressor impeller 8. As a result, the condensed water can be effectively discharged.

When the stator portion 14 is formed inside the housing 2, the condensed water may adversely affect the stator portion 14 by accumulating in the vicinity of the stator portion 14. For example, if the accumulated condensed water freezes while the electric compressor 1 is at rest, malfunction may occur upon restart. The condensed water is less likely to accumulate in the vicinity of the core portion 14*a* if the discharge passage 50 is connected at a location closer to the partition wall 4*a* than the core portion 14*a*. Negative effects on the stator portion 14 can thus be reduced.

The condensed water reservoir 46 being formed on the lower part of the housing 2 allows the condensed water to be stored in the condensed water reservoir 46 by the force of gravity. The condensed water can thus be collected at a fixed place inside the housing 2. When discharging the condensed water, the condensed water can also be discharged collectively from the condensed water reservoir 46.

The condensed water may vaporize during operation of the electric compressor 1 due to the inside of the housing 2 becoming hot. In vapor form, the condensed water can be discharged even if the discharge port (connection port 42) of the condensed water is on an upper part. However, when the temperature inside the housing 2 is relatively low as, for example, during startup of the electric compressor 1, the condensed water may be in liquid form. The connection port 42 of the discharge passage 50 being formed on the lower part of the housing 2 allows the condensed water to be discharged easily from the connection port 42 utilizing the pressure difference even when the condensed water is in liquid form. The condensed water reservoir 46 being formed on the lower part and the connection port 42 also being formed on the lower part facilitate reflux of the condensed water even when the condensed water is in liquid form.

The condensed water can be collected in the first groove portion 43 of the inner wall surface 3*d* and the second groove portion 44 of the inner wall surface 4*d*. The condensed water can be guided to the connection port 42 through the first groove portion 43 and the second groove portion 44 by the force of gravity.

The condensed water is refluxed to the extension suction pipe portion 6*b* from the high pressure part H. The condensed water accumulated inside the housing 2 can be discharged effectively utilizing the pressure difference in the electric compressor 1. There is no need to connect the discharge passage 50, for example, to upstream piping. The problem is solved by the electric compressor 1 alone.

Although the embodiments of the present disclosure have been described above, the present invention is not limited there to. For example, the discharge passage 50 is not limited to being formed outside the housing 2. The discharge passage 50 may be formed inside the housing 2 in which case the discharge pipe 41 is not required. Half the discharge passage 50 may be formed inside the housing 2 and for the other half, a discharge pipe may be used.

The discharge pipe 41 may be connected to piping upstream of the electric compressor 1. That is, the second end 41*b* of the discharge pipe 41 may be connected to piping upstream of the electric compressor 1. In this case, the discharge pipe 41 of the electric compressor 1 forms the discharge passage 50 for connecting the high pressure part H to the upstream piping (low pressure part L). That is, in the single electric compressor 1, even if the second end 41*b* of the discharge pipe 41 is not connected anywhere, if the second end 41*b* is intended to be connected to the low pressure part L (for example, when the connection portion 41*c* and the upstream piping are shaped to be able to be connected), it can be said that the discharge pipe 41 forms the discharge passage 50 for connecting the high pressure part H to the low pressure part L. The electric compressor 1, the upstream piping, and the discharge pipe enable a compressor system to be provided that can externally discharge the condensed water inside the housing 2.

While the condensed water reservoir 46 is formed on the lower part of the housing 2, a connection port (discharge port) may be formed in an area other than the lower part of the electric compressor 1 in use, such as in the upper part. The connection port or the condensed water reservoir 46 is not limited to being formed at a location closer to the partition wall 4*a* than the core portion 14*a*. The connection port or the condensed water reservoir may be formed in an area outward of the core portion 14*a* in the radial direction. It is still desirable in this case that the connection port is separated from the stator portion 14 so that the condensed water does not tend to contact the stator portion 14.

The present invention may be applied to an electric compressor with a turbine. The present invention may be applied to a centrifugal compressor other than the electric compressor 1 (a centrifugal compressor without the motor 5). The present invention may be applied to any centrifugal compressor in which the high pressure part H is formed.

INDUSTRIAL APPLICABILITY

According to some embodiments of the present disclosure, a discharge mechanism utilizing pressure difference is capable of externally discharging condensed water inside a housing with a simple configuration.

REFERENCE SIGNS LIST

1 Electric compressor (centrifugal compressor)
2 Housing
3 Motor housing
3*a* Partition wall
3*b* Peripheral wall
3*c* Flange portion
3*d* Inner wall surface
4 Inverter housing

4*a* Partition wall (end wall)
4*b* Peripheral wall
4*d* Inner wall surface
6 Compressor housing
6*a* Suction pipe portion
6*b* Extension suction pipe portion (suction portion
8 Compressor impeller
8*a* Rear face
12 Rotary shaft
14 Stator portion
14*a* Core portion
14*b* Coil portion
16 Peripheral wall
20A First bearing
20B Second bearing
31 Module
32 Bus bar assembly
41 Discharge pipe
42 Connection port
43 First groove portion
44 Second groove portion
45 Groove portion
46 Condensed water reservoir
50 Discharge passage
A1 Inner space
A2 Module installation space
H High pressure part
L Low pressure part
X Axis of rotation

The invention claimed is:

1. A centrifugal compressor comprising:
a compressor impeller attached to a rotary shaft; and
a housing accommodating the rotary shaft and the compressor impeller,
wherein the housing includes:
a suction portion formed upstream of the compressor impeller, and
a high pressure part formed on a rear face side of the compressor impeller and having a pressure higher than a pressure in the suction portion during rotation of the compressor impeller,
wherein the housing has a discharge passage formed for connecting the high pressure part of the housing to a low pressure part including the suction portion and a gas flow path upstream of the suction portion,
wherein the housing has a condensed water reservoir included in the high pressure part and formed on a lower part of the housing of the centrifugal compressor in use, and
wherein the discharge passage connects a lowermost part of the condensed water reservoir to the suction portion.

2. The centrifugal compressor according to claim 1, further comprising a stator portion disposed around the rotary shaft,
wherein the housing includes:
a peripheral wall formed on the rear face side of the compressor impeller and supporting a core portion of the stator portion; and
an end wall formed on an opposite side of the peripheral wall from the compressor impeller,
the high pressure part includes an inner space defined by the peripheral wall and the end wall, and
the discharge passage is connected to the inner space at a location closer to the end wall than the core portion.

3. The centrifugal compressor according to claim 1, wherein a connection port at which the discharge passage is connected to the high pressure part is formed on the lower part of the housing of the centrifugal compressor in use.

4. The centrifugal compressor according to claim 3, wherein the connection port is open to the condensed water reservoir.

5. The centrifugal compressor according to claim 3, wherein a groove portion extending toward the connection port is formed on an inner wall face of the housing.

6. The centrifugal compressor according to claim 4, wherein a groove portion extending toward the condensed water reservoir and the connection port is formed on an inner wall face of the housing.

7. The centrifugal compressor according to claim 1, wherein the discharge passage connects the high pressure part of the housing to the suction portion of the housing.

8. A centrifugal compressor comprising:
a compressor impeller attached to a rotary shaft;
a stator portion disposed around the rotary shaft; and
a housing accommodating the rotary shaft and the compressor impeller,
wherein the housing includes:
a suction portion formed upstream of the compressor impeller,
a high pressure part formed on a rear face side of the compressor impeller and having a pressure higher than a pressure in the suction portion during rotation of the compressor impeller,
a peripheral wall formed on the rear face side of the compressor impeller and supporting a core portion of the stator portion, and
an end wall formed on an opposite side of the peripheral wall from the compressor impeller,
wherein the housing has a discharge passage formed for connecting the high pressure part of the housing to a low pressure part including the suction portion and a gas flow path upstream of the suction portion,
wherein the housing has a condensed water reservoir included in the high pressure pan and formed on a lower part of the housing of the centrifugal compressor in use,
wherein the high pressure part includes an inner space defined by the peripheral wall and the end wall, and
wherein the discharge passage is connected to the inner space at a location closer to the end wall than the core portion.

9. The centrifugal compressor according to claim 8, wherein a connection port at which the discharge passage is connected to the high pressure part is formed on the lower part of the housing of the centrifugal compressor in use.

10. The centrifugal compressor according to claim 9, wherein the connection port is open to the condensed water reservoir.

11. The centrifugal compressor according to claim 9, wherein a groove portion extending toward the connection port is formed on an inner wall face of the housing.

12. The centrifugal compressor according to claim 10, wherein a groove portion extending toward the condensed water reservoir and the connection port is formed on an inner wall face of the housing.

13. The centrifugal compressor according to claim 8, wherein the discharge passage connects the high pressure part of the housing to the suction portion of the housing.

* * * * *